US006784334B2

(12) United States Patent
Jolimaitre et al.

(10) Patent No.: US 6,784,334 B2
(45) Date of Patent: Aug. 31, 2004

(54) PROCESS FOR SEPARATING MULTIBRANCHED PARAFFINS USING A ZEOLITIC ADSORBENT WITH A MIXED STRUCTURE

(75) Inventors: Elsa Jolimaitre, Paris (FR); Olivier Ducreux, Bougival (FR)

(73) Assignee: Institut Francais du Petrole, Rueil-Malmaison (FR)

( * ) Notice: Subject to any disclaimer, the term of this patent is extended or adjusted under 35 U.S.C. 154(b) by 0 days.

(21) Appl. No.: 09/935,658

(22) Filed: Aug. 24, 2001

(65) Prior Publication Data

US 2002/0045793 A1 Apr. 18, 2002

(30) Foreign Application Priority Data

Aug. 25, 2000 (FR) ..... 00 10974

(51) Int. Cl.[7] ..... C07C 7/12

(52) U.S. Cl. ..... 585/820; 585/822; 585/825; 585/826; 585/827; 585/831

(58) Field of Search ..... 585/820, 822, 585/825, 826, 827, 831

(56) References Cited

U.S. PATENT DOCUMENTS 5,744,684 A * 4/1998 Zinnen et al. ..... 585/702

FOREIGN PATENT DOCUMENTS

| | | |
|---|---|---|
| EP | 0 922 748 A1 | 6/1999 |
| EP | 0 934 996 A1 | 8/1999 |
| FR | 2 771 419 | 5/1999 |

* cited by examiner

*Primary Examiner*—Walter D. Griffin
*Assistant Examiner*—Tam M. Nguyen
(74) *Attorney, Agent, or Firm*—Millen, White, Zelano, Branigan, P.C.

(57) ABSTRACT

A process for separating multibranched paraffins comprised in a hydrocarbon feed comprising hydrocarbons containing 5 to 8 carbon atoms per molecule comprises a separation unit functioning by adsorption and contains at least one zeolitic adsorbent with a mixed structure with principal channels with openings defined by a ring containing 10 oxygen atoms and secondary channels with openings defined by a ring of at least 12 oxygen atoms, the secondary channels only being accessible to the feed to be separated via the principal channels. Particular zeolitic adsorbents of the invention are zeolites with structure types EUO, NES and MWW. NU-85 and NU-86 zeolites are also particularly suitable for carrying out the process of the invention.

17 Claims, 1 Drawing Sheet

Figure 1:
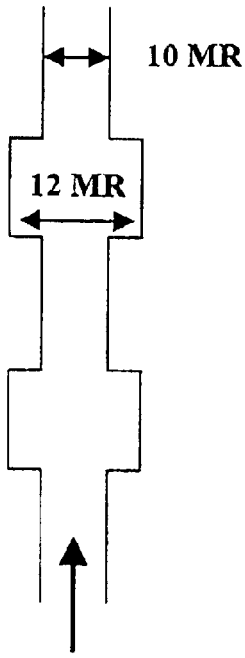

PROCESS FOR SEPARATING MULTIBRANCHED PARAFFINS USING A ZEOLITIC ADSORBENT WITH A MIXED STRUCTURE

The present invention relates to separating multibranched paraffins using at least one separation unit functioning by adsorption in which the adsorbent is a microporous zeolitic solid with a mixed structure, with channels with distinct sizes.

More particularly, the invention relates to the field of isomerisation of gasolines to improve their octane number. From the point of view of octane number, the hydrocarbons constituting the gasoline are preferably as highly branched as possible. Thus, a gasoline containing dimethylbutanes has a better octane number than a gasoline containing methylpentanes.

A number of techniques have been proposed in order to increase the octane number of a gasoline. Firstly, aromatic compounds, principal constituents of reforming gasolines, and isoparaffins produced by aliphatic alkylation or isomerisation of light gasolines, have compensated for the loss of octane number resulting from removing lead from gasolines, this removal being as a result of environmental constraints that are constantly being tightened up. As a result, oxygen-containing compounds such as methyl tertiobutyl ether (MTBE) or ethyl tertiobutyl ether (ETBE) have been introduced into the fuels. More recently, the acknowledged toxicity of compounds such as aromatics, in particular benzene, olefins and sulphur-containing compounds, and the desire to reduce the vapour pressure of gasolines, have resulted in the production of reformulated gasoline. As an example, since Jan. 1, 2000, the maximum olefin content, total aromatics content and benzene content of gasoline distributed in France are respectively 18% by volume, 42% by volume and 1% by volume. "Gasoline pools" comprise a number of components. The major components are reforming gasoline, which normally comprises 60% to 80% by volume of aromatic compounds, and FCC gasolines, which typically contain 35% by volume of aromatics but supply the majority of the olefinic and sulphur-containing compounds present in the gasoline pool. The other components can be alkylates, with neither aromatic compounds nor olefins, light isomerised or non isomerised gasolines, which contain no unsaturated compounds, oxygen-containing compounds such as MTBE, and butanes. Provided that the aromatics content is not reduced to below 35–40 vol %, the contribution of reformates to gasoline pools remains high, typically 40 vol %. In contrast, increased tightening of the maximum admissible aromatic compounds content to 20–25 vol % will cause a reduction in the use of reforming, and as a result will need straight run C7-C 10 cuts to be upgraded by methods other than reforming. Upgrading by hydroisomerisation is a possible route, as described in the patent application entitled "Process combining hydroisomerisation and separation using a zeolitic adsorbent with a mixed structure for the production of high octane number gasolines" deposited by the Applicant on the same day as the present application. The hydroisomerisation process results in the formation of multibranched compounds from compounds with lower octane numbers. It can only be carried out to recycle linear and monobranched C6–C10 paraffins, since the hydroisomerisation reaction is balanced and paraffins with low octane numbers cannot be sent to the "gasoline pool"

PRIOR ART

To increase the amount of multibranched paraffins in a feed from an isomerisation zone, it is possible to use molecular sieves that are selective because of the dimensions of their accessible pores.

Separation of linear, monobranched and multibranched paraffins by adsorption can be carried out by two different techniques that are well known to the skilled person: separation by differences in thermodynamic adsorption and separation by differences in the adsorption kinetics of the species to be separated. Depending on the technique employed, the adsorbent selected will have different pore diameters. Zeolites, composed of channels, are the adsorbents of choice to separate such paraffins.

The term "pore diameter" is known to the skilled person. It is used as a functional definition of pore size in terms of the size of the molecule that can enter into the pore. It does not define the actual dimension of the pore as that is often difficult to determine, since it often has an irregular shape (i.e., non circular). D. W. Breck provides a discussion on effective pore diameter in the book entitled "*Zeolite molecular sieves* (John Wiley & Sons, New York, 1974) on pages 633 to 641. The cross sections of the zeolite channels are rings of oxygen atoms, so the zeolite pore size can also be defined by the number of oxygen atoms forming the annular cross section of the rings, termed "member rings", MR. This is shown, for example, in "The atlas of zeolite structure types", W. M. Meier and D. H. Olson, $4^{th}$ edition, 1996), which indicates that FAU structure type zeolites have a crystal channel network of 12 MR, i.e, the cross section is constituted by 12 oxygen atoms. This definition is well known to the skilled person and will be used below.

In the case of "thermodynamic" separation, the adsorbent has a pore diameter that is higher than the critical diameter of the molecules to be separated. A number of patents describe the separation of multibranched paraffins from linear and monobranched paraffins by selective thermodynamic adsorption. U.S. Pat. No. 5,107,052 proposes preferably adsorption of multibranched paraffins on SAPO-5, AlPO-5, SSZ-24, MgAPO-5 or MAPSO-5 zeolites. U.S. Pat. No. 3,706,813 proposes the same type of selectivity on barium-exchanged X or Y zeolites. U.S. Pat. No. 6,069,289, on the other hand, proposes the use of zeolites with selectivities that are inversely proportional to the degree of branching of the paraffins, such as beta, X or Y zeolites exchanged with alkali or alkaline-earth cations, SAPO-31, MAPO-31 zeolites. All of the zeolites cited above have pore diameters of 12 MR In the case of "diffusional" separation, the separating power of the adsorbent is due to the difference in the diffusion kinetics of the molecules to be separated in the zeolite pores. In the case of separation of multibranched paraffins from monobranched and linear paraffins, the fact that the higher the degree of branching, the higher the kinetic diameter of the molecule, and thus the slower the diffusion kinetics, can be exploited. For the adsorbent to have a separating power, the adsorbent must have a pore diameter close to that of the molecules to be separated, which corresponds to zeolites with a pore diameter of 10 MR. Many patents describe the separation of linear, monobranched and multibranched paraffins by diffusional selectivity. U.S. Pat. Nos. 4,717,784, 4,804,802, 4,855,529 and 4,982,048 use adsorbents with channel sizes between 8 and 10 MR, the preferred adsorbent being ferrierite. U.S. Pat. No. 4,982,052 recommends the use of silicalite. U.S. Pat. Nos. 4,956,521, 5,055,633 and 5,055,634 describe the use of zeolites with elliptical cross section pores with dimensions in the range 5.0 to 5.5 Å along the minor axis and about 5.5 to 6.0 Å along the major axis, in particular ZSM-5 and its dealuminated form, or silicalite or with dimensions in the range 4.5 to 5.0 Å, in particular ferrierite, ZSM-23 and XZSM-11.

The zeolitic adsorbents proposed for diffusional separation of multibranched paraffins have a homogeneous channel size structure and are only composed of small channels (8 to 10 MR), which considerably reduces their adsorption capacity. Such materials, which suffer primarily from their low adsorption capacity, cannot result in optimum efficiency of the separation unit.

SUMMARY OF THE INVENTION

The present invention is based on the novel use of zeolitic adsorbents with a mixed structure, composed of two channel types with distinct sizes, in a section for separating multibranched paraffins comprised in a hydrocarbon feed comprising hydrocarbons containing 5 to 8 carbon atoms per molecule, in particular linear, monobranched and multibranched paraffins. The process of the invention comprises at least one separation unit functioning by adsorption and containing at least one zeolitic adsorbent with a mixed structure with principal channels with an opening defined by a ring of 10 oxygen atoms (also termed 10 MR) and secondary channels with an opening defined by a ring of at least 12 oxygen atoms (12 MR), the channels of at least 12 MR only being accessible to the feed to be separated via the 10 MR channels.

The zeolitic adsorbents of the invention are zeolites that advantageously have structure types EUO, NES and MWW. NU-85 and NU-86 zeolites are also particularly suitable for carrying out the process of the invention.

Importance of the Invention

The zeolitic adsorbents used in the separation section for implementing the process of the invention have substantially improved adsorbent properties over prior art adsorbents, in particular as regards the adsorption capacity itself. It has surprisingly been discovered that the use of a zeolitic adsorbent with at least two channel types with distinct sizes, principal channels with an opening defined by a ring of 10 oxygen atoms and secondary channels with an opening defined by a ring with at least 12 oxygen atoms, has a beneficial effect on the performance of a process for separating multibranched paraffins comprised in a hydrocarbon feed comprising hydrocarbons containing 5 to 8 carbon atoms per molecule. The zeolitic adsorbent used in the process of the invention combines good selectivity with optimum adsorption capacity, ensuring productivity gains over prior art adsorbents. This results in better yields for the process of the invention over other processes combining hydroisomerisation and separation by adsorption with prior art adsorbents.

The process of the invention is of particular advantage when coupled with a hydroisomerisation process as that allows linear and monobranched paraffins to be recycled.

DESCRIPTION OF THE INVENTION

The separation process of the invention uses at least one separation unit functioning by adsorption and containing at least one zeolitic adsorbent, which is brought into contact with a hydrocarbon feed comprising hydrocarbons containing 5 to 8 carbon atoms per molecule, in particular linear paraffins, monobranched paraffins and multibranched paraffins, to obtain at least two effluents, one of the effluents being rich in dibranched and tribranched paraffins and optionally in naphthenic and/or aromatic compounds.

The term "multibranched paraffins" as used below means paraffins with at least two branches. In accordance with the invention, the term "multibranched paraffins" includes dibranched paraffins.

The process of the invention is characterized in that said adsorbent has a mixed structure with principal channels with an opening defined by a ring with 10 oxygen atoms (10 MR) and secondary channels with an opening defined by a ring with at least 12 oxygen atoms (12 MR), the channels with at least 12 MR only being accessible via the 10 MR channels. Note that the 10 MR channels or 12 MR channels can be diagrammatically represented by a continuous succession of rings, each ring being constituted by 10 or 12 oxygen atoms. The invention is not limited to the use of a zeolitic adsorbent with channels with a specific number of rings. In particular, the invention also encompasses separating multibranched paraffins with an adsorbent with 10 MR channels restricted to a single ring. These zeolitic adsorbents can have a one-, two- or three-dimensional structure.

In accordance with the invention, the zeolitic adsorbent preferably adsorbs linear paraffins, monobranched paraffins to a lesser extent and finally, minor amounts of multibranched paraffins, naphthenic compounds and aromatic compounds.

The feed treated in the process of the invention originates from a C5 to C8 cut or any intermediate cut (such as C5–C7, C6–C8, C6–C7, C7–C8, C7 or C8), or comprising paraffin hydrocarbons and optionally naphthenic, aromatic and olefinic hydrocarbons. Such cuts can originate from atmospheric distillation of a crude, from a reforming unit (light reformate) or from a conversion unit (naphthene hydrocracking, for example). The remainder of the text will refer to this set of possible feeds as "C5–C8 cuts and intermediate cuts".

The feed treated in the process of the invention is principally composed of linear, monobranched and multibranched paraffins, naphthenic compounds such as dimethylcyclopentanes, aromatic compounds such as benzene or toluene, and possibly olefinic compounds.

The feed can contain normal pentane, 2-methylbutane, neopentane, normal hexane, 2-methylpentane, 3-methylpentane, 2,2-dimethylbutane, 2,3-dimethylbutane, normal heptane, 2-methylhextane, 3-methylhexane, 2,2-dimethylpentane, 3,3-dimethylpentane, 2,3-dimethylpentane, 2,4-dimethylpentane, 2,2,3-trimethylbutane, normal octane, 2-methylheptane, 3-methylheptane, 4-methylheptane, 2,2-dimethylhexane, 3,3-dimethylhexane, 2,3-dimethylhexane, 3,4-dimethylhexane, 2,4-dimethylhexane, 2,5-dimethylhexane, 2,2,3-trimethylpentane, 2,3,3-trimethylpentane, or 2,3,4-trimethylpentane. If the feed originates from C5–C8 feeds and/or intermediate cuts obtained after atmospheric distillation (such as C5–C7, C6–C8, C6–C7, C7–C8, C7 or C8), it can also contain cyclic alkanes, such as dimethylcyclopentanes, aromatic hydrocarbons (such as benzene, toluene, xylenes) and other C9+hydrocarbons (i.e., hydrocarbons containing at least 9 carbon atoms) in smaller quantities. Feeds constituted by C5–C8 cuts or intermediate cuts of reformate origin can also contain olefinic hydrocarbons, in particular when the reforming units are operated at low pressure.

The paraffin content (P) essentially depends on the origin of the feed, i.e., its paraffinic or naphthenic or aromatic nature, occasionally measured by the parameter N+A (sum of the naphthene content (N) and the aromatics content (A)), and its initial boiling point, i.e., the amount of C5 and C6 in the feed. In hydrocracking naphthas, rich in naphthenic compounds, or light reformates, rich in aromatic compounds, the amount of paraffins in the feed is generally low, of the order of 30% by weight. In straight run C5–C8 cuts and intermediate cuts (such as C5–C7, C6–C8, C6–C7, C7–C8, C7, C8), the paraffin content varies between 30% and 80% by weight, with a mean value of 55–60% by weight.

The treated feed comprising paraffins containing 5 to 8 carbon atoms generally has a low octane number and the process of the invention consists of fractionating it into at least two distinct effluents, one of the effluents being rich in dibranched and tribranched paraffins and possibly in naphthenic and/or aromatic compounds. Depending on the conditions of use, it is also possible to separate the feed into three distinct effluents with increasing motor and research octane number, respectively rich in linear paraffins, monobranched paraffins and in dibranched and tribranched paraffins and optionally naphthenic and/or aromatic paraffins.

In accordance with the invention, fractionation is carried out in a separation unit containing one or more adsorbents, at least one of the adsorbents being a zeolitic solid with a mixed structure the microporous network of which has both principal channels with an opening defined by a ring of 10 oxygen atoms (10 MR) and secondary channels the opening of which is defined by a ring with at least 12 oxygen atoms (12 MR), said principal and secondary channels being disposed such that access to the secondary channels of at least 12 MR is only possible via the principal 10 MR channels.

These different adsorbents have channel sizes such that each of the isomers in the C5–C8 cuts or intermediate cuts can be adsorbed. The diffusion kinetics of these isomers in the 10 MR channels is sufficiently different, however, to be exploited.

In accordance with the invention, optimum diffusion selectivity is obtained by stopping the multibranched molecules from entering via the 10 MR channels and with an optimum adsorption capacity that is obtained by the presence of channels of at least 12 MR.

Clearly, the separation process of the invention is based on the difference in adsorption kinetics of the species to be separated and thus exploits the characteristics of "diffusional" separation.

Figure 2:
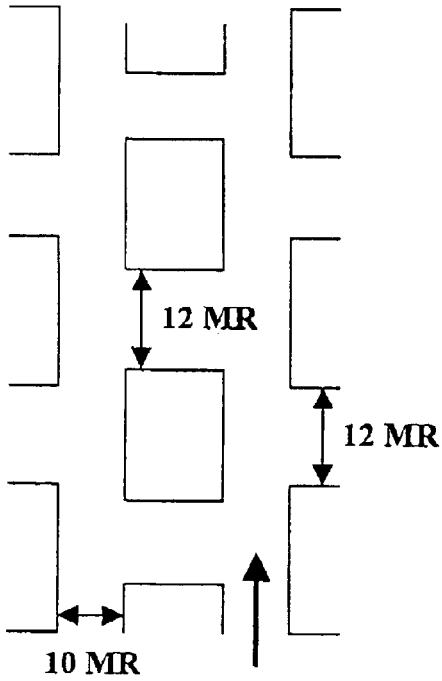

Channels of at least 12 MR can either be simple side pockets (see FIG. 1) or they can form porous segments perpendicular to the 10 MR channels, such that those segments are only accessible via the 10 MR channels (see FIG. 2).

The adsorbents used to carry out the process of the invention advantageously contain silicon and at least one element T selected from the group formed by aluminium, iron, gallium and boron, preferably aluminium and boron. The silica content in these adsorbents can vary. Adsorbents that are the most suitable for this type of separation are those with high silica contents. The Si/T mole ratio is preferably at least 10.

Said microporous adsorbents can be in the acidic form, i.e., containing hydrogen atoms, or preferably they are exchanged with alkali or alkaline-earth cations.

It is advantageous to mix the zeolitic adsorbents with zeolites with structure type LTA, as described in U.S. Pat. No. 2,882,243, preferably A zeolite. In the majority of their cation exchanged forms, in particular the calcium form, these zeolites have a pore diameter of the order of 5 Å, and have high linear paraffin adsorption capacities. Mixed with zeolitic adsorbents with a structure as defined above, they can accentuate separation of the elution fronts and resulting in better purity for each of the enriched fluxes obtained.

Advantageously, the zeolitic adsorbents used in the process of the invention are zeolites with structure type EUO, NES and MWW. Examples of zeolites included in this family are EU-1 zeolites (European patent EP-A-0 042 226), ZSM-50 (U.S. Pat. No. 4,640,829), TPZ-3 (U.S. Pat. No. 4,695,667), NU-87 (EP-A-0 378 916), SSZ-37 (U.S. Pat. No. 5,254,514), MCM-22, ERB-1 (EP-A-0 293 032), ITQ-1 (U.S. Pat. No. 6,004,941), PSH-3 (U.S. Pat. No. 4,439,409), and SSZ-25 (EP-A-0 231 860). NU-85 zeolites (U.S. Pat. No. 5,385,718 and EP-A-0 462 745) and NU-86 zeolites (EP-A-0 463 768), the structure type of which have not been determined, are also advantageously used in the process of the invention.

Zeolites with structure type EUO (EU-1, ZSM-50, TPZ-3) have a one-dimensional pore network. The principal channels have 10 MR openings and they are provided with side pockets corresponding to an opening of 12 MR. The configuration of these zeolites with structure type EUO is shown in FIG. 1.

Zeolites with structure type NES (NU-87 and SSZ-37) have an interconnected two-dimensional network. In one direction are the 10 MR channels, connected together by porous 12 MR segments, perpendicular to the 10 MR channels. The 12 MR channels are thus only accessible via the 10 MR channels. The configuration of these zeolites with structure type NES is that shown in FIG. 2.

It should be stated that NU-85 is a hybrid of NU-87 and EU-1 zeolites: each NU-85 crystal comprises discrete bands of NU-87 and EU-1, said bands enjoying continuity of the crystalline network between them.

NU-86 zeolite has a three-dimensional pore network. In one of its dimensions are channels containing 11 oxygen atoms (11 MR). In the other two dimensions are channels with 12 oxygen atoms with 10 MR restrictions. The 12 MR channels are only accessible via the 10 MR channels. The configuration of the NU-86 zeolite is that shown in FIG. 1.

Zeolites with structure type MWW (MCM-22, ERB-1, ITQ-1, PSH-3, SSZ-25) have a non-interconnected two-dimensional network. One of the pore networks is constituted by 10 MR channels, and the second is constituted by 12 MR channels connected together via 10 MR channels, such that access to the 12 MR channels is only via 10 MR channels. The configuration of these zeolites with structure type MWW is shown in FIG. 1.

Any other zeolitic adsorbent with principal channels with the opening defined by a ring of 10 oxygen atoms and secondary channels with an opening defined by a ring with more than 12 oxygen atoms is suitable for carrying out the process of the invention.

The separation process of the present invention can employ adsorption separation techniques that are well known to the skilled person, such as PSA (pressure swing adsorption), TSA (temperature swing adsorption) and chromatographic processes (elution chromatography or simulated counter-current, for example) or a combination of those techniques. The separation process of the invention can also be operated in the liquid phase or in the gas phase. Further, in general, a plurality of separation units (two to fifteen) are used in parallel and in alternation to produce a section operating continuously although it is discontinuous by nature.

The separation unit for the process of the invention uses at least one adsorbent or an eluent that can be adsorbed or not adsorbed. When the feed contains a C5 cut, isopentane from this cut can either be separated by the process of the invention with the monobranched or multibranched paraffins depending on the selected implementation, or it can be withdrawn from the fluxes traversing the process using at least one deisopentaniser disposed upstream and/or downstream of the separation unit. In the latter case, the isopentane can act as the eluent to implement separation.

More generally, it is advantageous to remove one or more light fractions from the feed upstream of the adsorber or one or more light fractions from the fluxes obtained at the outlet from the adsorber enriched either in linear paraffins or in monobranched paraffins, said light fraction or fractions being separated by distillation. These different light fractions can then act as an adsorbable eluent to implement separation. As an example, a depentaniser can be placed upstream and/or downstream of the adsorber in the case when the feed contains the C5 cut. The pentane and isopentane-rich mixture recovered can than act as an eluent to implement separation. The combination of a deisopentaniser and a depentaniser is also possible. The separated isopentane, pentane or mixture of pentane and isopentane can act as an eluent for the separation process.

The process of the invention is of particular application when it is coupled with a hydroisomerisation unit. The separation process of the invention, producing at least two distinct effluents, one with a high octane number and the other with a low octane number, and integrated into a process also comprising at least one hydroisomerisation unit, can recycle the low octane number effluent to the hydroisomerisation unit, which then converts the linear and monobranched paraffins with a low octane number to multibranched paraffins with a high octane number.

The operating conditions for the separation section depend on the adsorbent or adsorbents under consideration, and on the desired degree of purity of each of the fluxes. The conditions are a temperature in the range 50° C. to 450° C., and a pressure of 0.01 to 7 MPa. More precisely, if separation is carried out in the liquid phase, the separation conditions are: a temperature of 50° C. to 250° C. and a pressure of 0.1 to 7 MPa, preferably 0.5 to 5 MPa. If said separation is carried out in the gas phase, the conditions are: a temperature of 150° C. to 450° C., and a pressure of 0.01 to 7 MPa, preferably 0.1 to 5 MPa.

The following examples illustrate the invention without limiting its scope.

EXAMPLE 1

In Accordance with the Invention

The zeolitic adsorbents studied were EU-1 zeolites (one-dimensional structure with side pockets) and NU-87 (two-dimensional structure). These zeolites were in their $Na^+$ exchanged form, i.e., each of the as synthesised zeolites, once calcined, underwent successive ion exchange steps with a 1N NaCl solution, at ambient temperature. The EU-1 zeolite had a Si/B ratio of 24 and the NU-87 zeolite had a Si/Al ratio of 16.

a) Adsorption Capacity

The adsorption capacities of the EU-1 and NU-87 were measured gravimetrically at different temperatures (100° C. and 200° C.) at a partial pressure of 200 mbars of isopentane (iC5) using a TAG 24 symmetrical thermobalance from SETARAM. Before each adsorption measurement, the solids were regenerated for 4 hours at 380° C. The results are shown in Table 1 below:

TABLE 1 adsorption capacity of EU-1 and NU-87 zeolites

| Temperature | Mass of iC5 adsorbed (mg/g) with an iC5 partial pressure of 200 mbar | |
|---|---|---|
| (° C.) | EU-1 | NU-87 |
| 100 | 80.3 | 92.9 |
| 200 | 49.6 | 58.8 |

b) Diffusional Selectivity

The diffusional selectivities of normal hexane (nC6), 2-methylpentane (2MP) and 2,2-dimethylbutane (2,2DMB) were determined experimentally by reverse chromatography. To this end, the response of a fixed bed of zeolite to an "impulse" type concentration perturbation was measured. A 10 cm column filled with 1.4 g of zeolite, maintained at a constant temperature of 200° C., was traversed by a 1 nl/h flow of nitrogen. The pressure in the column was 1 bar and it were operated in the gas phase. The responses of the column to injection of different hydrocarbons was measured. The results obtained are shown in Table 2, in the form of a first moment ($\mu_1$) or average residence time and a second moment ($\mu_2^c$) or curve variance. The "moment" analysis (see p. 246 in the work by D. Ruthven, "Principles of adsorption and adsorption processes", John Wiley & Sons, New York, 1984) teaches that the global resistance to material transfer R can be calculated using the following equation:

$$R = \frac{\mu_2^c}{2 \cdot \mu_1^2} \cdot \frac{L}{v}$$

in which L is the length of the bed and v is the interstitial velocity in the bed.

This resistance is also shown in Table 2.

TABLE 2

| Zeolite | Temperature (° C.) | Hydrocarbon | $\mu_1$ (min) | $\mu_2^c$ (min$^2$) | R (min) |
|---|---|---|---|---|---|
| EU-1 | 200 | nC6 | 54.3 | 2074.1 | 5.1 |
| | | 2 MP | 20.6 | 330.1 | 5.6 |
| | | 2,2 DMB | 0 | 0 | ∞ |
| NU-87 | 200 | nC6 | 59.3 | 1220.5 | 2.5 |
| | | 2 MP | 40.1 | 1068.3 | 4.8 |
| | | 2,2 DMB | 13.1 | 546.1 | 22.9 |

The ratio α between the global resistances of 2 MP and 2,2DMB and between the global resistances of 2MP and nC6 were calculated to evaluate the diffusional selectivity of zeolites EU-1 and NU-87 in separating these three hydrocarbons. The values of α were calculated at 200° C. for EU-1 and NU-87. These values are shown in Table 3.

TABLE 3

| Zeolite | Temperature (° C.) | α (2,2DMB/2MP) | α (2MP/nC6) |
|---|---|---|---|
| EU-1 | 200 | ∞ | 1.1 |
| NU-87 | 200 | 4.76 | 1.9 |

EXAMPLE 2

Comparative

The tests described in Example 1 were repeated under the same operating conditions, using silicalite zeolite with a three-dimensional structure as the zeolitic adsorbent. The silicalite had structure type MFI and had only 10 MR channels. It was in its $Na^+$ form and had a Si/Al ratio of 250.

a) Adsorption Capacity

TABLE 4

| Temperature (° C.) | Mass of iC5 adsorbed (mg/g) with a partial pressure of iC5 of 200 mbar |
|---|---|
| 100 | 47.0 |
| 200 | 24.0 |

Comparing the results of Tables 1 and 4, it can be seen that the adsorption capacities of EU-1 and NU-87 are higher than the adsorption capacities of silicalite at the temperatures under consideration. The adsorption capacity for iC5 is about 1.9 times higher than that of silicalite for EU-1 and 2.2 times for NU-87.

b) Diffusional Selectivity

TABLE 5

| Zeolite | Temperature (° C.) | Hydrocarbon | $\mu_1$ (min) | $\mu_2^c$ ($min^2$) | R (min) |
|---|---|---|---|---|---|
| Silicalite | 200 | nC6 | 28.7 | 321.5 | 2.8 |
| | | 2 MP | 16.3 | 388.5 | 3.2 |
| | | 2.2 DMB | 7.5 | 183.0 | 13.3 |

TABLE 6

| Zeolite | Temperature (° C.) | α (2,2DMB/2MP) | α (2MP/nC6) |
|---|---|---|---|
| Silicalite | 200 | 4.17 | 1.2 |

Comparing the results shown in Tables 3 and 6, it can be seen that zeolites EU-1 and NU-87 have very advantageous diffusional selectivities for separating hydrocarbons with different degrees of branching. In particular, 2,2DMB does not penetrate at all into the pores of the EU-1 zeolite (Table 2) under the experimental conditions given above, and the selectivity of this zeolite for separating 2,2DMB and 2MP is thus infinite, much greater than that of silicalite. The NU-87 zeolite has a better selectivity for separating 2,2DMB and 2MP than silicalite at 200° C., and it also has better selectivity than silicalite for separating 2MP and nC6.

In conclusion, NU-87 and EU-1 zeolites have a better capacity for adsorption than silicalite and a diffusional selectivity that is generally better to guarantee a gain in productivity with respect to a multibranched paraffin separation section using silicalite.

What is claimed is:

1. A process for separating multibranched paraffins comprised in a hydrocarbon feed comprising hydrocarbons containing 5 to 8 carbon atoms per molecule, wherein said hydrocarbon feed contains linear, monobranched and multibranched paraffins, comprising:

bringing said hydrocarbon feed into contact with at least one zeolitic adsorbent whereby multibranched paraffins are separated from said hydrocarbon feed, and fractionating said hydrocarbon feed into at least two distinct effluents, a first effluent comprising multibranched paraffins and having a high octane number, and a second effluent which has a low octane number, said adsorbent having at least two types of channels, principal channels with an opening defined by a ring of 10 oxygen atoms and secondary channels with an opening defined by a ring of at least 12 oxygen atoms, said secondary channels only being accessible to said hydrocarbon feed via said principal channels, wherein said zeolitic adsorbent is a zeolite with structure type NES, a zeolite with structure type MWW, a NU-85 zeolite, or a NU-86 zeolite.

2. A separation process according to claim 1, wherein said adsorbent contains silicon and at least one element T selected from the group formed by aluminium, iron, gallium and boron, the Si/T mole ratio being at least 10.

3. A process according for separating multibranched paraffins comprised in a hydrocarbon feed comprising hydrocarbons containing 5 to 8 carbon atoms ver molecule, wherein said hydrocarbon feed contains linear, monobranched and multibranched paraffins, comprising:

bringing said hydrocarbon feed into contact with at least one zeolitic adsorbent whereby multibranched paraffins are separated from said hydrocarbon feed, and fractionating said hydrocarbon feed into at least two distinct effluents, a first effluent comprising multibranched paraffins and having a high octane number, and a second effluent which has a low octane number, said adsorbent having at least two types of channels, principal channels with an opening defined by a ring of 10 oxygen atoms and secondary channels with an opening defined by a ring of at least 12 oxygen atoms, said secondary channels only being accessible to said hydrocarbon feed via said principal channels, wherein said zeolitic adsorbent comprises a zeolite with a EUO, NES, or MWW structure, or an NU-85 or NU-86 zeolite, said zeolitic adsorbent being mixed with a zeolite type LTA.

4. A separation process according to claim 1, wherein said hydrocarbon feed originates from atmospheric distillation of crude petroleum.

5. A separation process according to claim 1, wherein said hydrocarbon feed originates from a reforming unit.

6. A separation process according to claim 1, said hydrocarbon feed originates from a conversion unit.

7. A separation process according to claim 1, wherein said first effluent rich in multibranched paraffins further contains aromatic and naphthenic compounds.

8. A separation process according to claim 1, wherein said fractionating of said hydrocarbon feed produces three distinct effluents, said first effluent which is rich in multibranched paraffins and optionally in aromatic and naphthenic compounds, said second effluent which is rich in linear paraffins, and a third effluent which is rich in monobranched paraffins.

9. A process according to claim 1, wherein, before said hydrocarbon feed is brought into contact with said at least one zeolitic adsorbent, at least one light fraction is separated from said hydrocarbon feed by distillation, or, after said hydrocarbon feed is brought into contact with said at least one zeolitic adsorbent, at least one light fraction is separated from an effluent by distillation.

10. A process according to claim 1, wherein the feed contains a C5 cut, and before said hydrocarbon feed is brought into contact with said at least one zeolitic adsorbent, said hydrocarbon feed is sent to at least one deisopentaniser and/or at least one depentaniser, or after said hydrocarbon feed is brought into contact with said at least one zeolitic adsorbent, an effluent is sent to at least one deisopentaniser and/or at least one depentaniser.

11. A separation process according to claim 9, wherein said light fraction or isopentane and/or pentane and/or a mixture of the two substances acts as an eluant to implement separation.

12. A separation process according to claim 1, wherein separation is carried out in the liquid phase at a temperature in the range 50° C. to 250° C. and at a pressure in the range 0.1 to 7 MPa.

13. A separation process according to claim 1, wherein separation is carried out in the gas phase at a temperature in the range 150° C. to 450° C. and at a pressure in the range 0.01 to 7 MPa.

14. A process for separating multibranched paraffins comprised in a hydrocarbon feed comprising hydrocarbons containing 5 to 8 carbon atoms per molecule, wherein said hydrocarbon feed contains linear, monobranched and multibranched paraffins, comprising:

bringing said hydrocarbon feed into contact with at least one zeolitic adsorbent whereby multibranched paraffins are separated from said hydrocarbon feed, said adsorbent having at least two types of channels, principal channels with an opening defined by a ring of 10 oxygen atoms and secondary channels with an opening defined by a ring of at least 12 oxygen atoms, said secondary channels only being accessible to said hydrocarbon feed via said principal channels, wherein said zeolitic adsorbent is selected from zeolites with structure type NES, zeolites with structure type MWW, NU-85 zeolites, and NU-86 zeolites.

15. A process for separating multibranched paraffins comprised in a hydrocarbon feed comprising hydrocarbons containing 5 to 8 carbon atoms per molecule, wherein said hydrocarbon feed contains linear, monobranched and multibranched paraffins, comprising:

bringing said hydrocarbon feed into contact with at least one zeolitic adsorbent whereby multibranched paraffins are separated from said hydrocarbon feed, said adsorbent having at least two types of channels, principal channels with an opening defined by a ring of 10 oxygen atoms and secondary channels with an opening defined by a ring of at least 12 oxygen atoms, said secondary channels only being accessible to said hydrocarbon feed via said principal channels, wherein said zeolitic adsorbent comprises a zeolite with a EUO, NIES, or MWW structure, or an NU-85 or NU-86 zeolite, said zeolitic adsorbent being mixed with a zeolite type LTA.

16. process according to claim 1, wherein said hydrocarbon feed has paraffin content between 30% and 80% by weight.

17. A process according to claim 14, wherein said zeolite is a NU-87 zeolite, a SSZ-37 zeolite, a MCM-22 zeolite, a ERB-1 zeolite, a ITQ-1 zeolite, a PSH-3 zeolite, a SSZ-25 zeolite, a NU-85 zeolite or a NU-86 zeolite.

* * * * *

UNITED STATES PATENT AND TRADEMARK OFFICE

CERTIFICATE OF CORRECTION

PATENT NO. : 6,784,334 B2
DATED : August 31, 2004
INVENTOR(S) : Jolimaitre et al.

It is certified that error appears in the above-identified patent and that said Letters Patent is hereby corrected as shown below:

Column 10,
Line 12, delete “according”
Line 14, delete “ver” and insert -- per --.

Column 12,
Line 16, delete “NIES” and insert -- NES --.

Signed and Sealed this

First Day of February, 2005

JON W. DUDAS
*Director of the United States Patent and Trademark Office*